US008109748B2

(12) United States Patent
Merendeiro et al.

(10) Patent No.: US 8,109,748 B2
(45) Date of Patent: Feb. 7, 2012

(54) GEAR TOOTH AND EXTERNAL GEAR PUMP

(75) Inventors: Joao Merendeiro, Gafanha Da Nazare (PT); Jose Ribafeita, Gafanha Da Nazare (PT); Que Vu Do, Lagord (FR)

(73) Assignee: Renault S.A.S., Boulogne Billancourt (FR)

( * ) Notice: Subject to any disclaimer, the term of this patent is extended or adjusted under 35 U.S.C. 154(b) by 857 days.

(21) Appl. No.: 10/568,585

(22) PCT Filed: Jul. 21, 2004

(86) PCT No.: PCT/FR2004/001925

§ 371 (c)(1),
(2), (4) Date: Jul. 11, 2007

(87) PCT Pub. No.: WO2005/021972

PCT Pub. Date: Mar. 10, 2005

(65) Prior Publication Data

US 2007/0274853 A1 Nov. 29, 2007

(30) Foreign Application Priority Data

Aug. 20, 2003 (FR) ..... 03 10040

(51) Int. Cl.

| | |
|---|---|
| ***F01C 1/18*** | (2006.01) |
| ***F01C 1/24*** | (2006.01) |
| ***F03C 2/08*** | (2006.01) |
| ***F04C 2/08*** | (2006.01) |
| ***F04C 2/18*** | (2006.01) |

(52) U.S. Cl. ..... 418/206.5; 418/205; 418/206.1

(58) Field of Classification Search ..... 418/150, 418/201.3, 205, 206.1, 206.5, 196, 197
See application file for complete search history.

(56) References Cited

U.S. PATENT DOCUMENTS

| | | | | | |
|---|---|---|---|---|---|
| 533,292 | A | * | 1/1895 | Green | 418/206.5 |
| 559,703 | A | * | 5/1896 | Green | 418/206.5 |
| 2,447,104 | A | * | 8/1948 | Trbojevich | 74/462 |
| 2,462,924 | A | * | 3/1949 | Ungar | 418/201.3 |
| 2,701,683 | A | * | 2/1955 | Whitfield | 418/201.3 |
| 3,089,638 | A | * | 5/1963 | Rose | 418/150 |
| 3,182,900 | A | * | 5/1965 | Thorson | 418/188 |
| 3,323,499 | A | * | 6/1967 | Gijbeis | 123/217 |
| 3,817,667 | A | * | 6/1974 | Winkelstrater et al. | 418/206.5 |
| 4,003,349 | A | * | 1/1977 | v. Habsburg-Lothringen | 123/246 |
| 4,145,168 | A | * | 3/1979 | Smith et al. | 418/150 |
| 4,224,015 | A | * | 9/1980 | Nagata | 418/201.3 |
| 4,224,016 | A | * | 9/1980 | Brown | 418/191 |
| 4,324,538 | A | * | 4/1982 | Brown | 418/191 |
| 5,149,256 | A | * | 9/1992 | Schmitz | 418/150 |
| 5,154,149 | A | * | 10/1992 | Turner | 123/249 |
| 6,361,289 | B1 | * | 3/2002 | Hennes et al. | 417/310 |
| 6,364,642 | B1 | * | 4/2002 | Garczorz et al. | 418/15 |
| 6,814,045 | B2 | * | 11/2004 | Masters | 123/241 |

FOREIGN PATENT DOCUMENTS

DE 100 03 735 11/2000

(Continued)

*Primary Examiner* — Mary A Davis
(74) *Attorney, Agent, or Firm* — Oblon, Spivak, McClelland, Maier & Neustadt, L.L.P.

(57) ABSTRACT

A gear tooth including a concave base connected to its starting point at the root of the adjacent tooth and a top connected to the base via a first transition point. The top of the tooth includes two convex segments connected via a second transition point causing a curve break in the tooth profile.

13 Claims, 4 Drawing Sheets

FOREIGN PATENT DOCUMENTS

| | | | | | |
|---|---|---|---|---|---|
| GB | 439 908 | 12/1935 | JP | 64036992 A | * 2/1989 |
| GB | 981 964 | 2/1965 | | | |

* cited by examiner

GEAR TOOTH AND EXTERNAL GEAR PUMP

BACKGROUND OF THE INVENTION

I. Field of the Invention

The present invention relates to a gear tooth and to a pump, especially an oil pump equipped with corresponding gears.

More precisely, this invention has as its object a gear tooth provided with a root that is concave at its point of separation from the root of the neighboring tooth, and with a top joined to the said root.

This tooth is used preferably but not exclusively in an external gear pump provided with at least one pair of mutually meshed toothed pinions.

Such a pump, which is also the object of the invention, can be used in an internal combustion engine, but the invention is also applicable to all external gear pumps.

II. Discussion of the Background

The oil pumps used in engines are of two types: external gear pumps with straight or spherical involute teeth, and internal gear pumps, with straight trochoidal or spherical involute tooth profiles.

Modern generations of engines, and especially those of their accessories, place greater demands of oil flow and pressure on the pumps used. Moreover, the limits on space requirement within the engine environment are becoming increasingly tighter.

The conventional methods adopted to increase the hydraulic performances of gear pumps are in particular increase in the pump speed, increase in the height of the pump gears, reduction of the hydraulic backlash or increase in the number of pinions.

Nevertheless, oil pumps have low volumetric efficiencies at low speed, so that they are generally overdimensioned at high speed, and it is often necessary to discharge a large part—even as much as half—of the oil pumped at high speed via a discharge valve.

Different toothing profiles exist for external gear pumps. The standard geometry, of the straight spherical involute toothing type, has modest performances. In fact, any attempt to increase the volume of oil displaced by optimizing the tooth profile rapidly runs into problems of different constraints. The possibility of increasing the outside diameter of the tooth is limited by the small thickness thereof and by the risk of having an overly pointed tooth. In addition, elongation of the tooth results in a disadvantage for continuity of meshing, especially at the root of the tooth. Finally, the interference between the base circle and the root of the tooth also suffers from elongation thereof.

A traditional tooth profile for a gear pump comprises a trochoidal concave base followed by a spherical involute top.

It has already been proposed to improve the performances of an external gear pump by abandoning the spherical involute profiles in favor of other profiles such as epicycloids or hypocycloids joined to the primitive circle of the toothed gear, or in other words to the theoretical circular line that rolls over an equivalent line of the opposite tooth.

However, the gains achieved in this way compared with traditional toothings are insufficient. Moreover, by deviating therefrom, difficult technical choices and an increase in manufacturing costs are rapidly encountered.

SUMMARY OF THE INVENTION

The objective of the present invention is to increase the volume of oil displaced between the teeth by optimizing their profile without harming the continuity of meshing. More precisely, the sought objective is to increase the flow, pressure and volumetric efficiency at low speed in a gear pump, without increasing its space requirement.

With this objective, the invention proposes that the top of each tooth be provided with two convex sectors joined by a transition point defining a discontinuity in curvature.

The second active point of the profile thus defines the bottom of a notch made in the tooth profile.

According to a preferred embodiment of the invention, the first convex sector of the top of the tooth has a spherical involute profile.

Finally, the pump proposed by the invention is provided with two toothed gears, which may or may not be identical.

BRIEF DESCRIPTION OF THE DRAWINGS

Other characteristics and advantages of the invention will become clearly apparent upon reading the description hereinafter of a particular embodiment thereof with reference to the attached drawings, wherein.

DETAILED DESCRIPTION OF THE INVENTION

Figure 1:
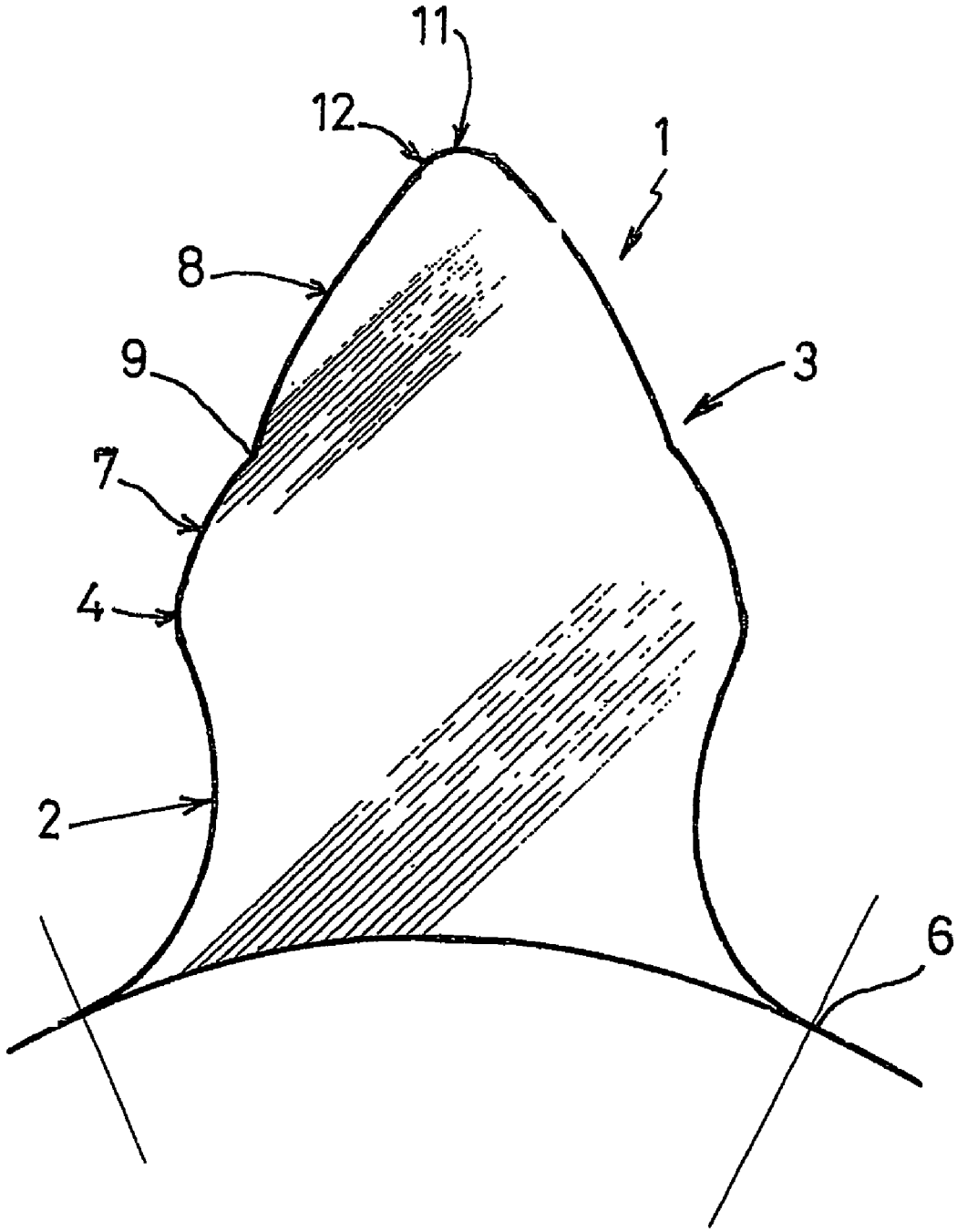
FIG. 1 represents a sectional view of a tooth of a toothed gear according to the invention.

FIG. 1 demonstrates the two main parts of tooth 1, namely its root 2 and its top 3, joined by an active transition point 4. Root 2 has a concave shape, and it is joined at its origin 6 to the root of the neighboring tooth (not shown in FIG. 1).

According to the invention, the top of the tooth has two convex sectors 7, 8, joined by an active transition point 9, defining a discontinuity in curvature. Transition point 9 defines the bottom of a notch made in the tooth profile.

According to another characteristic of the invention, convex sector 7 following first transition point 4 has a spherical involute profile. This spherical involute profile therefore extends between the two active transition points 4 and 9 of tooth 1, and it constitutes a first convex sector of root 2.

Second convex sector 8, or convex extension profile, which follows point 9, can also have a spherical involute profile, although this particular configuration is not imperative and it is possible to envision other extension profiles for this second convex sector without departing from the scope of the invention.

Finally, the top of the tooth has a rounded end sector 11, joined to the second convex sector 8 by a transition sector 12.

The tooth is symmetric, and the shape of end sector 11 of the teeth matches that of the concave sector defined by juxtaposition of two roots 2 of neighboring teeth, in such a way that the end sector of one tooth can roll between two teeth of the opposite gear, while maintaining contact therewith until it slips away from them.

Finally, the two toothed gears of the pump can be identical, and this characteristic adds a considerable advantage for the proposed pump in terms of process and of manufacturing costs.

Referring to FIGS. 2A to 2F (FIG. 2F corresponding to the same meshing situation as FIG. 2A for the following teeth), it is evident that there are several points of contact between the teeth. In these figures the double circles represent what are known as the primary bearing points, by which the driving gear moves the driven gear, and the single circles represent secondary contact points making it possible to ensure elimination of operational backlash and continuity of meshing.

Figure 2A:
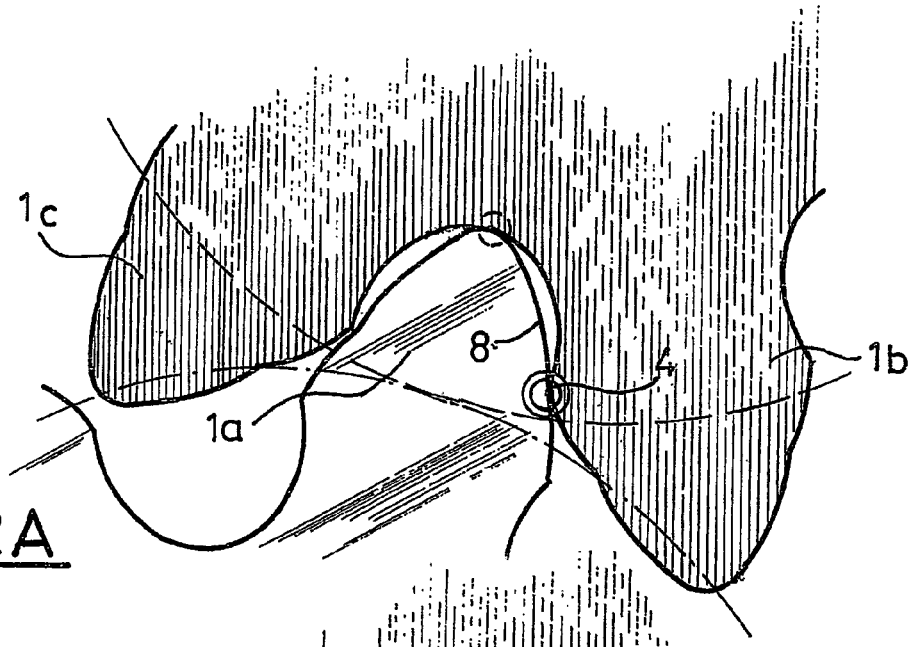
FIGS. 2A to 2F illustrate the meshing of two gears of the pump, and FIGS. 3A and 3B demonstrate the advantages achieved by the invention.
Figure 2B:
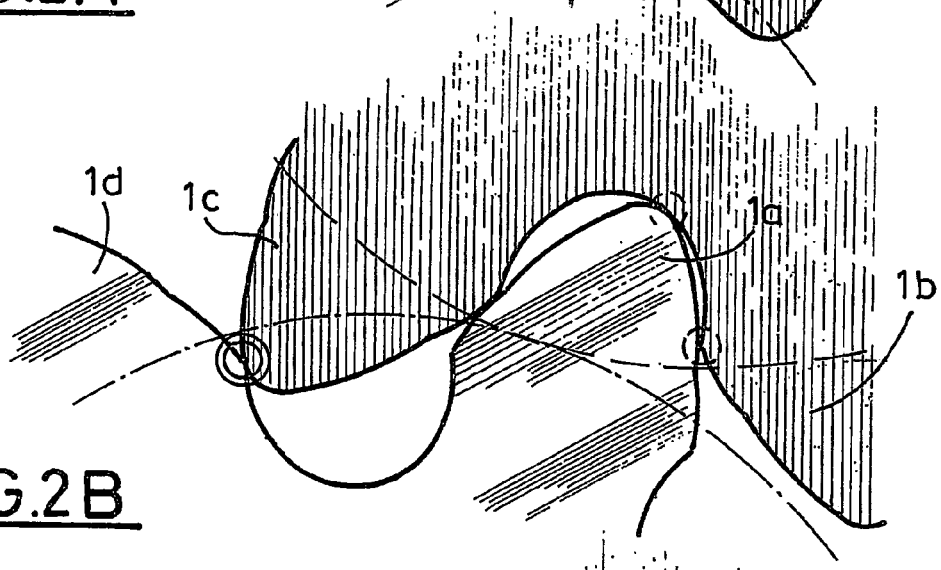

In FIG. 2A, the tooth 1*a* of a first gear has just passed the axis of symmetry of the opposite tooth space. Via its convex surface 8, it is in primary bearing relationship (double circle) with active transition point 4 of the opposite tooth 1*b*, while its end sector 11 is rolling over concave root 2 thereof.

After a slight relative displacement of teeth 1*a*, 1*b* (FIG. 2B), it is evident that the two preceding bearing points have been displaced and that both are now secondary contact points, while the primary bearing point between the two gears is now located between end 11 of tooth 1*c* of the first gear and root 2 of the following tooth 1*d* of the other gear.

Figure 2C:
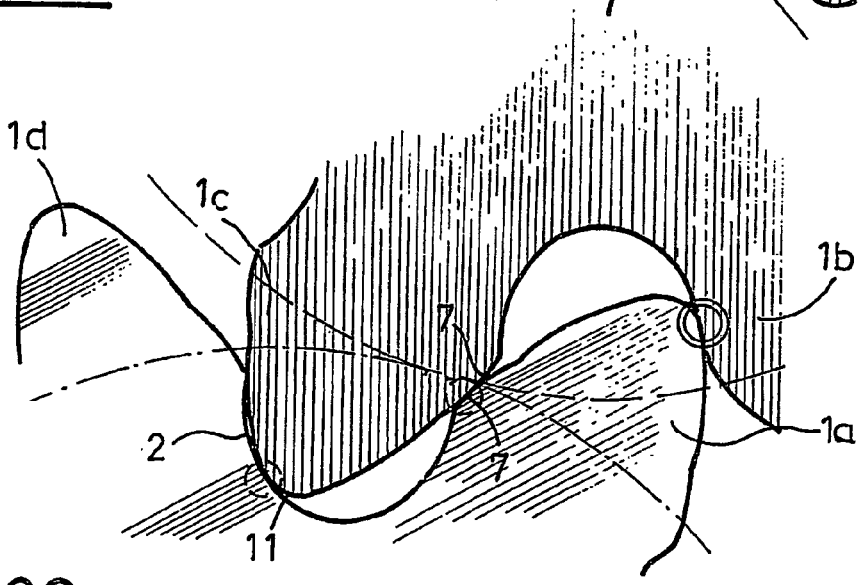

In FIG. 2C, the primary bearing point is between convex profile 8 of gear 1*a* and root 2 of gear 1*a*, while two secondary contact points are located between the two gears 1*b* and 1*c*, respectively between end sector 11 of tooth 1*c* and the root of a new tooth 1*d*, and between the two convex sectors 7 of teeth 1*a* and 1*c*.

Figure 2D:
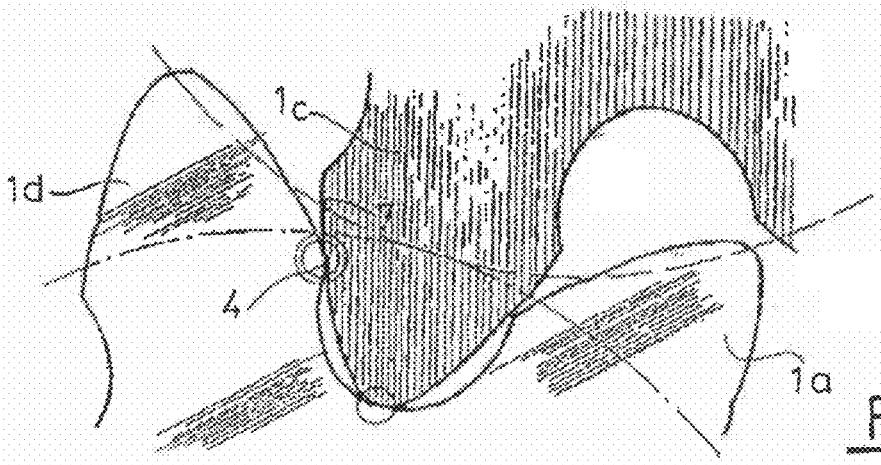

In FIG. 2D, the primary bearing point is located between convex sector 7 of tooth 1*c* and active transition point 4 of tooth 1*d*, while the top of gear 1*c* is rolling in the transition zone of teeth 1*a* and 1*d*.

Figure 2E:
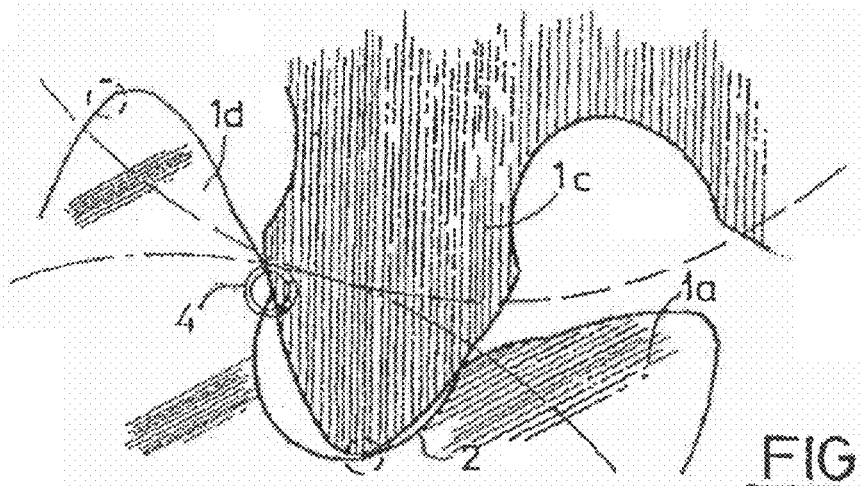

The end sector continues to roll over root 2 of tooth 1*a*, while the primary bearing point is located between active transition point 4 of tooth 1*d* and convex sector 7 of tooth 1*c* (FIG. 2E).

Figure 2F:
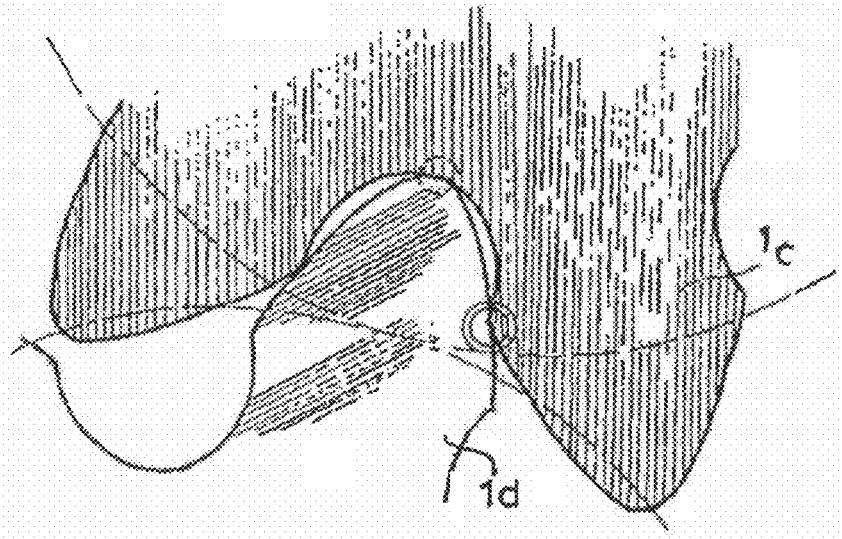

Finally, in FIG. 2F, the situation is once again analogous to that of FIG. 2A, but in this case between teeth 1*c* and 1*d*.

These figures demonstrate an important characteristic of the invention, wherein first transition point 4 of one tooth rolls over first convex sector 7 of a tooth of the opposite gear. Similarly, they demonstrate that a given active point of one tooth is successively a primary bearing point and a secondary contact point in the course of meshing. Finally, as indicated in the diagrams, the teeth of both gears are in contact over more than one tooth pitch during meshing.

Figure 3A:
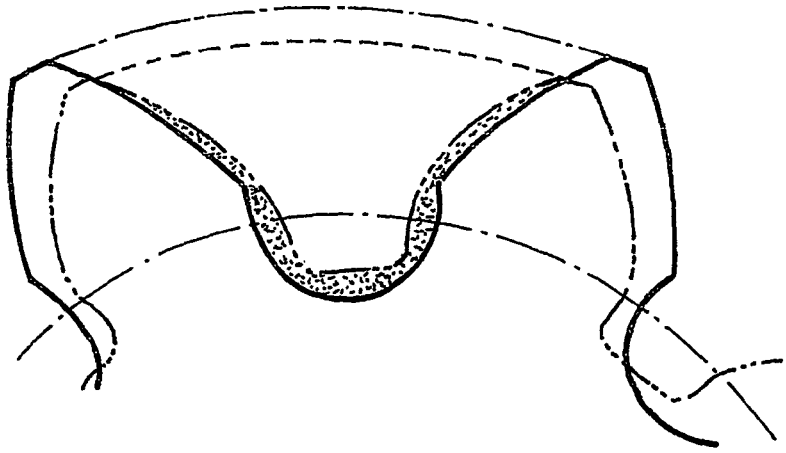

FIG. 3A shows the very large increase of tooth-space volume displaced compared with a traditional spherical involute tooth, by virtue of elongation of the tooth height and of enlargement of the gap between the teeth.

Figure 3B:
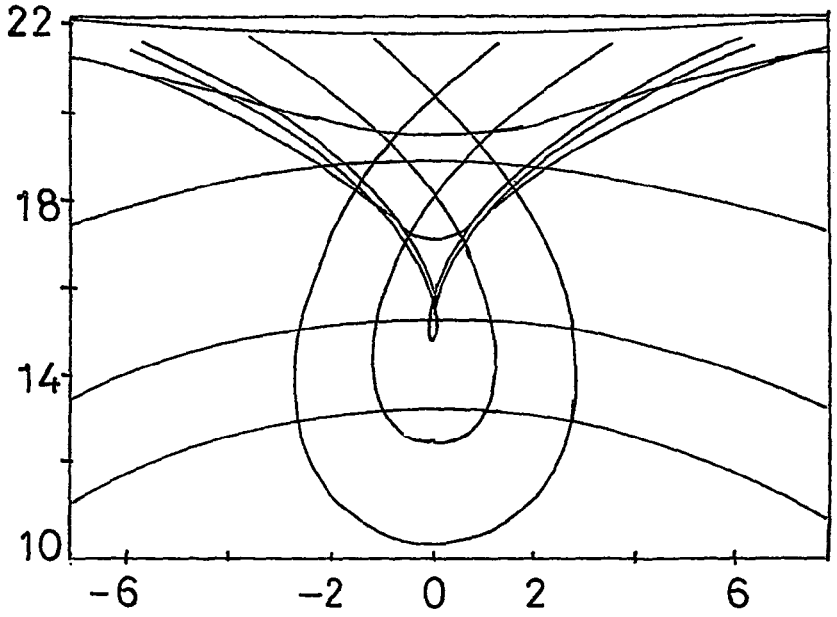

FIG. 3B is a theoretical figure showing the different trajectories of several points of the inventive tooth profile in the tooth space of the mating pinion, with a pronounced elongated epicyclic effect permitting the large increase of displaced volume.

In conclusion, it must be emphasized that the inventive tooth profile has the feature of combining spherical involute sectors, whose advantages are already known, with rolling sectors having special profiles. This combination simultaneously ensures continuity of meshing, a sufficient path of toothing contact and a very large increase of displaced oil volume. In particular, the inventive tooth profile permits a gain in flow, especially at low speed, on the order of 30% to 40% compared with the traditional spherical involute toothing of pumps.

The invention claimed is:

1. An external gear pump, comprising:

at least one pair of mutually meshed toothed gears including a driving gear and a driven gear, each tooth of the gears being comprised of a root including two concave root sectors, with each of the concave root sectors being joined at an origin to a concave root sector of a neighboring tooth, and a top including a first side and a second side, with each of the sides of the top joined to a respective one of the concave root sectors by a first transition point, wherein each of the sides of the top includes two convex sectors joined by a second transition point defining a discontinuity in curvature of a profile of the tooth, wherein the teeth in mesh have at all times at least one primary bearing point by which the driving gear moves the driven gear, and at least one secondary contact point, and wherein the first transition point of one of the teeth in mesh is successively the primary bearing point and the secondary contact point in the course of meshing.

2. The gear pump according to claim 1, wherein the second transition point defines a bottom of a notch made in the tooth profile.

3. The gear pump according to claim 1, wherein the convex sector following the first transition point has a spherical involute profile.

4. The gear pump according to claim 1, wherein the convex sector following the second transition point has a spherical involute profile.

5. The gear pump according to claim 1, wherein the top of the tooth includes a rounded end sector joined to each of the convex sectors following the second transition point by a transition sector.

6. The gear pump according to claim 1, wherein two of the toothed gears are identical.

7. The gear pump according to claim 1, wherein the first transition point on one side of one tooth rolls over a convex sector on one side of a tooth of an opposite meshed gear.

8. The gear pump according to claim 1, wherein a shape of an end sector of the teeth matches a shape of a concave sector defined by juxtaposition of two roots of neighboring teeth.

9. The gear pump according to claim 1, wherein an end sector of one tooth rolls between two teeth of an opposite meshed gear, while maintaining contact therewith until the one tooth slips away from the two teeth of the opposite meshed gear.

10. The gear pump according to claim 1, wherein the teeth of two meshed gears are in contact over more than one pitch.

11. The gear pump according to claim 1, wherein at least one tooth of the mutually meshed gears is symmetric.

12. The gear pump according to claim 1, wherein each tooth of the mutually meshed gears is symmetric.

13. The gear pump according to claim 1, wherein, when the one of the teeth in mesh is successively the secondary contact point, the primary contact point of the teeth in mesh is on a next tooth downstream in a direction of rotation of the pair of gears, and after the primary contact point is on the next tooth, the primary contact point is transferred back to the one of the teeth in mesh that is upstream from the next tooth before the next tooth is out of mesh.

* * * * *